United States Patent [19]

Maas et al.

[11] 3,954,134

[45] May 4, 1976

[54] APPARATUS FOR TREATING METAL MELTS WITH A PURGING GAS DURING CONTINUOUS CASTING

[75] Inventors: Hermann Maas, Bochum; Horst Abratis, Hagen; Claus Raeune, Hattingen, all of Germany

[73] Assignee: Rheinstahl Huettenwerke AG, Essen, Germany

[22] Filed: Aug. 23, 1974

[21] Appl. No.: 499,910

Related U.S. Application Data

[62] Division of Ser. No. 257,421, May 26, 1972, Pat. No. 3,886,992.

[30] Foreign Application Priority Data

Mar. 28, 1971 Germany ..... 2126606

[52] U.S. Cl. ..... 164/266; 164/281; 222/559; 266/216

[51] Int. Cl.[2] ..... B22D 41/08; B22D 35/04

[58] Field of Search ..... 266/38; 164/55, 56, 164/66, 82, 259, 266, 281; 222/559

[56] References Cited

UNITED STATES PATENTS

| | | | |
|---|---|---|---|
| 3,200,457 | 8/1965 | Wagstaff | 222/559 X |
| 3,459,346 | 8/1969 | Tinnes | 266/38 X |

FOREIGN PATENTS OR APPLICATIONS

| | | | |
|---|---|---|---|
| 808,711 | 2/1937 | France | 266/38 |
| 443,705 | 5/1940 | Italy | 266/38 |

*Primary Examiner*—Robert B. Reeves
*Assistant Examiner*—David A. Scherbel
*Attorney, Agent, or Firm*—Werner W. Kleeman

[57] ABSTRACT

An apparatus for treating metal melts during continuous casting, wherein the teeming metal is enclosed to a point below the surface of the metal pool in the continuous casting mold to avoid contact with the ambient atmosphere and the surface of the pool is covered with a layer of slag. Small volumes of purging gas are introduced in bubble form into the metal melt at the location where such metal melt begins to form a teeming jet.

3 Claims, 1 Drawing Figure

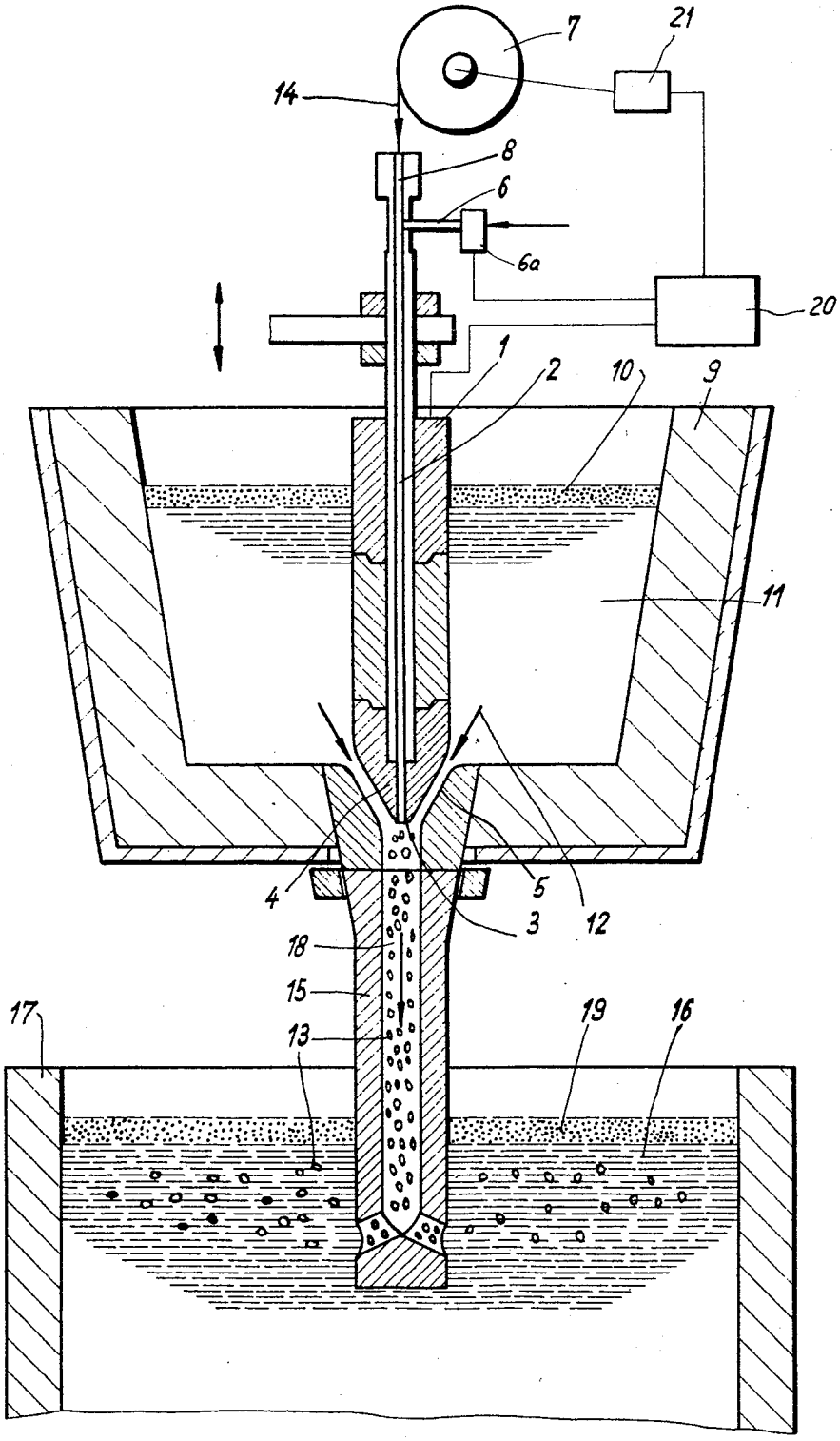
7
21
14
8
6
6a
20
1
2
10
9
11
4
5
3
12
18
15
13
17
19
16

APPARATUS FOR TREATING METAL MELTS WITH A PURGING GAS DURING CONTINUOUS CASTING

CROSS-REFERENCE TO RELATED CASE

This application is a divisional application of our copending United States Pat. application Ser. No. 257,421, filed May 26, 1972, now U.S. Pat. No. 3,886,992.

BACKGROUND OF THE INVENTION

The present invention relates to a new and improved apparatus for treating metal melts during continuous casting while enclosing the teeming metal to below the surface of the metal pool in the mold to prevent contact with the ambient atmosphere, covering the surface of the pool with a layer of slag and introducing gases into the teeming metal.

A method of treating the metal with a purging gas during continuous casting in a tundish fitted with a pouring tube or pipe has been disclosed in German petty Pat. No. 7,023,173. The arrangement disclosed in such patent which consists of a blowing orifice in the bottom of the tundish in the vicinity of the pouring nozzle has a very modest purifying effect, since the depth of the bath in a tundish is only about 30 to 40 cms. and therefore offers only a short path for the passage of the gas through the steel melt. Hence, the purifying effect regarding the purging of undesirable gaseous constituents in the melt and the removal of non-metallic occlusions or inclusions is very slight. Moreover, when entering the tundish nozzle the steel may pick up fresh oxidic impurities. The maintenance and insertion of porous purging bricks in the tundish is time-consuming and expensive.

It has already been proposed according to U.S. Pat. No. 3,502,249 to deliver major volumes of gas, which as known are needed for controlling the teeming rate, through the stopper rod to the outlet nozzle of a ladle. As such these large volumes of gas cause the metal jet to spatter and they have no significant purifying effect because they do not enter the metal pool in the mold below its surface. The spattering of the teeming jet entering the atmosphere is intended to be prevented by the provision of an expansion chamber.

In the published French Pat. application No. 2,035,336 it is proposed to pass gas through the porous wall of a pouring nozzle to prevent products of oxidation from being deposited and choking the nozzle, particularly when pouring aluminum-killed steel. The introduction of gas around the periphery of the teeming jet does not result in an intimate comixture of gas and steel so that the purifying effect is very limited. The porosity needed for the admission of the gas weakens the brick and leads to premature wear. Moreover, during service difficulties arise in the supply of the gas.

U.S. Pat. No. 2,005,311 describes the passage of major volumes of gas through the stopper rod of a ladle for the purpose of cooling same. This arrangement also has no purifying effect.

Conventional methods of suppressing oxidic impurities during continuous casting have been unable to prevent coarse and principally fine impurities from being deposited, particularly in the marginal zones to depths of about 1½ cms., a circumstance which in the further processing of ingots and slabs by rolling necessitates the expense of subsequent scarfing and/or the considerable loss of material involved in machining.

SUMMARY OF THE INVENTION

In view of the above-described state of the art it is a primary object of the present invention to devise an apparatus for treating metallic melts in a manner enabling these undesirable oxidic accumulations to be substantially reduced.

Another object of the invention is to bring about a satisfactory dissolution and even distribution of any deoxidants and/or alloying elements that may be also introduced into the melt.

Furthermore, when casting slabs of rectangular cross-section another object of the invention is to reduce the frequency of transverse cracking by controlling the pattern of flow in the casting head and, when aluminum-containing steels are cast to prevent the pouring pipes from being choked.

According to the invention these objects and others which will become more readily apparent as the description proceeds are achieved with the proposed method by introducing small volumes of purging gases in bubble form into the melt where the teeming jet is being formed.

The proposed method of introducing the gas into the center of the teeming jet as the jet forms, in conjunction with the injector-like action of the teeming metal, results in the gas being divided into a multiplicity of very small bubbles having diameters not exceeding about 5mm. which provide an intimate mixture between the gas and steel. The injector effect also assists in keeping the gas exit opening clear. The proposed method produces continuous castings which are substantially free from surface occlusions or inclusions. Moreover, macroscopic purity is greatly improved. The small bubbles are particularly good for picking up oxidic impurities. By introducing the gas at the point where the teeming jet is in the course of formation they are forced to travel a long way through the liquid steel and the probability of collisions between gas bubbles and oxide impurities and the resultant purifying effects are thus greatly improved. During the slow ascent of the gas bubbles in the pool they readily take-up the non-metallic occlusions or inclusions and convey them to the slag on the surface of the liquid pool. The small gas volume has the further advantage that the surface of the pool is not violently agitated and that there is avoided contamination of the casting by particles of slag from the floating slag cover. The small bubbles affect the pattern of flow in the mold in the direction of reducing descending components of flow. The small bubbles are carried into the critical surface zones where they float upwards in the descending steel and thus purge this zone of the casting which is particularly liable to exhibit faults. The lift imparted to the descending metal at the solidification boundary by the rising bubbles affects metal flow and enables the impurities to float up, so that the probability of impurities being intercepted by the surface zones is greatly diminished.

The accumulation of products of oxidation in the nozzles through which the metal flows cannot occur when the proposed method is adopted. It is a known fact that the entrainment by the teeming jet of particles that have grown during periods of deposition leads to the appearance of larger and injurious occlusions in the steel.

When casting aluminum-containing slabs the proposed method also operates to prevent the flow orifice from being choked. In the application of the proposed method to the casting of rectangular sections the provision of the teeming jet with gas bubbles also leads to a reduction of the velocity of flow towards the narrow sides of the section. The thermal stressing of this zone which is particularly liable to develop cracks is thus reduced and the occurrence of transverse cracks can be reduced.

In detail the invention can be further developed in the following advantageous ways.

By introducing, simultaneously with the purging gases, and at the same point of delivery, deoxidants and/or alloying elements, a satisfactory dissolution and uniform distribution of the alloying elements in the casting can be achieved and the deoxidation products can be precipitated by the action of the gas bubbles.

During continuous casting the velocity of flow is by no means constant but is subject to fluctuations — even disregarding the slower pouring rate when starting. The velocity is adjusted by the position of a closure means in the pouring vessel or in the tundish. In order to achieve a very uniform distribution of deoxidants and alloying elements, even when the pouring rates fluctuate, the invention proposes to introduce the deoxidants and/or alloying elements continuously at rates corresponding to the existing pouring rate. For compensating losses of alloying elements which have a high affinity for oxygen, such as aluminium and titanium, losses which increase as casting continues, the invention proposes to introduce the deoxidants and/or alloying elements at progressively increasing rates as casting continues.

For performing the proposed method of continuous casting a pouring vessel is particularly appropriate which contains a closure means below which a pouring pipe or tube extends to below the surface of the pool in the mold, and in which these means in their interior contain a longitudinal conduit which has its bottom end in the region where the metal begins to form a teeming jet, whereas at its upper end it is provided with one or more supply means. For example the closure means may comprise a stopper rod fitted with a cone or ball head. The purging gases as well as alloying elements, if these are to be added, in such case are introduced from a supply at the top into the stopper rod and issue from the exit end of the conduit at the ceramic head of the rod.

The pouring vessel may in detail and with advantage comprise the following features:

For the generation of small gas bubbles the exit opening for the gas should have a cross-section of between 0.2 and 7 sq.mm.

A uniform introduction of alloying elements and deoxidants can be achieved if at the upper end of the conduit there is provided, besides the supply means for the gas, a second supply means comprising a wire roll, drive means and a funnel for guiding the wire into the conduit. The drive means permits the wire to be introduced into the steel at the exit end of the conduit, either at a constant or a controlled rate, the end of the wire being melted as it makes contact with the flowing steel and being thus uniformly distributed in the steel. By selecting a suitable rate of feed the introduction of the alloying element can be at a constant rate. Since the entry funnel embraces the wire without much clearance blow-by through the wire supply funnel of a purging gas that is being introduced is avoided. Purging gases which have proved to be particularly satisfactory include the noble gases, e.g. argon. Preferably the volumetric rate of gas introduction should be between 3 litres (S.T.P.) and 18 litres (S.T.P.) per minute.

For controlling and regulating the rate of introduction of the additives it is desirable to drive the wire roll by an electric motor which is speed-controlled according to the position of the stopper rod.

Moreover, it is also advantageous if the volume of gas introduced matches the pouring rate. Experiments have shown that an excellent purifying effect can be achieved when the ratio of the volume of the poured steel to the volume of the argon gas introduced is between 40 : 1 and 10 : 1. For adapting the gas volume to the pouring rate the invention proposes to incorporate a regulating valve in the gas supply and to control the valve according to the position of the stopper rod. A conventional needle valve would be an appropriate control valve for this purpose.

BRIEF DESCRIPTION OF THE DRAWING

An embodiment of the invention will be hereinafter described with reference to the drawing which shows a tundish and the upper end of a continuous casting mold in section.

DETAILED DESCRIPTION OF THE INVENTION

In the proposed method of purifying casting melts during the process of continuous casting the teeming metal 18 is protected from the ambient atmosphere by being enclosed in a pouring pipe or tube 15 which extends to below the surface 16 of the pool of metal in a continuous casting mold 17. The surface of the pool 16 is covered with slag 19. Through a suitable device 1, which in the illustrated embodiment is a stopper rod, a small volume of purging gas is introduced at the rate of 10 litres (S.T.P.) per minute when teeming begins out of the pool 11. The gas is admitted from a gas supply 6 which may incorporate a regulating valve **6*a* of conventional design, and thus only schematically depicted, and controlled with reference to the position of the stopper rod 1 by means of a suitable control mechanism 20. The ratio of the teemed volume of steel to the volume of gas i.e. argon introduced is 20 : 1. The stopper rod 1 contains a conduit 2 extending axially along its length and ending at location or exit opening 3 in the sealing 4 centrally outside the seating surface 5 in the region where the metal enters the pouring pipe. When exclusively gas is introduced the diameter of the exit opening 3 is between about 0.5 and 3 mm. For example, a diameter of 1 mm. for a pouring rate of 1.3 tons/-minute has proved to be most advantageous. When casting slabs for the production of sheet material the surface faults were reduced to below 50% of their usual frequency when using untreated melts. Faults in the interior of the sheets in two rolling mills were found to be only 38 and 28% of the number of faults found to occur when using untreated melts. Besides a purging gas alloying elements and deoxidants in the form of wire 14 may also be introduced through the conduit 2. In such a case the exit opening 3 should be such that a free cross-section for the issuing gas of between 0.2 and 7 sq.mm. still remains. The wire 14 is introduced from a driven supply roll 7 into the conduit 2 through a funnel 8 which surrounds the wire with little clearance. When this arrangement is used for pouring, the steel 11 which is covered by a protective layer of slag 10 in the tundish 9 flows past the exit of the conduit 2 and extrains the purging gas, such as argon, in the form of small bubbles 13 and simultaneously melts away the end of wire 14 which may be drawn from the supply roll 7 and fed down the conduit 2 by standard drive means 21, such as a speed-controlled electric motor, the speed of which may be controlled by the control mechanism 20 as a function of the position of the stopper rod 1. The steel 11, the bubbles of argon 13 and the dissolved alloying wire 14 travel gate the pouring pipe or tube 15 with the exclusion of air to a point below the surface of the metal pool 16 in the mold 17. The gas bubbles 13 rise in the mold 17 and separate out non-metallic occlusions or inclusions in the covering slag layer 19.**

Instead of the stopper shown in the illustrated embodiment, the closure or closure means may have the form of a sliding gate nozzle. For introducing the gas and any possible additions in such case the means 1 above the sliding gatte would be a lance instead of a stopper rod.

While there is shown and described present preferred embodiments of the invention, it is to be distinctly understood that the invention is not limited thereto but may be otherwise variously embodied and practiced within the scope of the following claims. ACCORDINGLY,

What is claimed is:

1. An apparatus for treating metal melts during continuous casting by means of a continuous casting mold, comprising a pouring vessel, said pouring vessel including means defining a region where the metal melt begins to form a teeming jet, a pouring pipe provided for said pouring vessel and capable of extending to a point beneath the surface of the metal pool in the continuous casting mold, means disposed above said pouring and containing internally thereof a substantially longitudinally extending conduit which opens at its bottom end at the region defining means of the pouring vessel where the metal begins to form said teeming jet, said longitudinally extending conduit being provided at its bottom end with a gas exit opening having a cross-sectional area between 0.2 and 7 square millimeters, said means disposed above said pouring pipe being provided at the region of its upper end with at least one supply means, and wherein said supply means serves for the supply of a purging gas, a further supply means located at the region of the upper end of said conduit, said further supply means comprising a driven wire roll, drive means for said roll, and a funnel for guiding a wire into said conduit.

2. An apparatus for treating metal melts during continuous casting by means of a continuous casting mold, comprising a pouring vessel, said pouring vessel including means defining a region where the metal begins to form a teeming jet, a pouring pipe provided for said pouring vessel and capable of extending to a point beneath the surface of the metal pool in the continuous casting mold, means disposed above said pouring pipe and containing internally thereof a substantially longitudinally extending conduit which opens at its bottom end at the region defining means of the pouring vessel where the metal begins to form said teeming jet, said means disposed above said pouring pipe being provided at the region of its upper end with at least one supply means, said supply means serving for the supply of a purging gas, a further supply means located at the region of the upper end of said conduit, said further supply means comprising a driven wire roll, drive means for said roll, and a funnel for guiding a wire into said conduit, and wherein said means disposed above the pouring pipe is in the form of a stopper rod, and means for driving said driven wire roll as a function of the position of the stopper rod.

3. An apparatus for treating metal melts during continuous casting be means of a continuous casting mold, comprising a pouring vessel, said pouring vessel including means defining a region where the metal begins to form a teeming jet, a pouring pipe provided for said pouring vessel and capable of extending to a point beneath the surface of the metal pool in the continuous casting mold, means disposed above said pouring pipe and containing internally thereof a substantially longitudinally extending conduit which opens at its bottom end at the region defining means of the pouring vessel where the metal melt begins to form said teeming jet, said means disposed above said pouring pipe being provided at the region of its upper end with at least one supply means, and wherein said means disposed above said pouring pipe comprises a stopper rod, said supply means serves for the supply of a gas and incorporates a regulating valve, means for controlling said regulating valve as a function of the position of said stopper rod.

* * * * *